US006287390B2

(12) United States Patent
Sakai et al.

(10) Patent No.: US 6,287,390 B2
(45) Date of Patent: Sep. 11, 2001

(54) APPARATUS AND METHOD OF CLEANING NOZZLE AND APPARATUS OF PROCESSING SUBSTRATE

(75) Inventors: Hiroyuki Sakai, Kumamoto-ken; Kazutaka Matsuo, Kumamoto, both of (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/780,436

(22) Filed: Feb. 12, 2001

Related U.S. Application Data

(62) Division of application No. 09/313,775, filed on May 18, 1999, now Pat. No. 6,210,481.

(30) Foreign Application Priority Data

May 19, 1998 (JP) ..... 10-153907

(51) Int. Cl.[7] ..... B08B 3/02
(52) U.S. Cl. ..... 134/18
(58) Field of Search ..... 134/902, 57 R, 134/58 R, 95.2, 95.3, 98.1, 103.2, 113, 104.1, 153, 199, 18; 118/697, 712, 52, 70

(56) References Cited

U.S. PATENT DOCUMENTS 4,977,911 * 12/1990 Vetter et al. ..... 134/34
5,405,087 * 4/1995 Waryu et al. ..... 239/288
5,779,796 * 7/1998 Tomoeda et al. ..... 134/153 X
5,927,305 * 7/1999 Shiba ..... 134/153

FOREIGN PATENT DOCUMENTS

58830 * 3/1988 (JP) ..... 118/70
8621 * 1/1989 (JP) ..... 118/70
5-166715 7/1993 (JP) .

* cited by examiner

*Primary Examiner*—Philip R. Coe
(74) *Attorney, Agent, or Firm*—Oblon, Spivak, McClelland, Maier & Neustadt, P.C.

(57) ABSTRACT

An apparatus of cleaning a nozzle comprising a mounting table for mounting a substrate to be processed, a process liquid nozzle having a liquid output portion for outputting a process liquid toward the substrate mounted on the table, a nozzle cleaning mechanism having a fluid spray portion for spraying a cleaning fluid onto the liquid output portion of the process liquid nozzle to remove an attached material from the liquid output portion by the cleaning fluid sprayed from the fluid spray portion, and a nozzle moving mechanism for moving the process liquid nozzle between the mounting table and the nozzle cleaning mechanism.

3 Claims, 7 Drawing Sheets

APPARATUS AND METHOD OF CLEANING NOZZLE AND APPARATUS OF PROCESSING SUBSTRATE

CROSS REFERENCE TO RELATED APPLICATIONS

This application is a divisional application of Ser. No. 09/313,775 filed May 18, 1999, and now U.S. Pat. No. 6,210,481, and claims priority to Japanese Application No. 10-153907 filed May 19, 1998.

BACKGROUND OF THE INVENTION

The present invention relates to an apparatus and method of cleaning nozzle and an apparatus of processing a substrate.

In a photolithographic process for use in manufacturing semiconductor devices, resist is coated on a wafer and the resultant wafer is pattern-exposed to light and then developed. In a developing process, a developing solution is supplied so as to spread over an entire surface of the wafer. To describe more specifically, the developing solution is mounted on a stationary wafer, and then, a latent image is developed by use of natural convection of the developing solution. After the development, the wafer is rotated at a high speed to remove the developing solution from the wafer, rinsed and dried.

As the developing solution, for example, an aqueous tetramethylammonium hydroxide (TMAH) solution is used. When the aqueous TMAH solution is attached to a tip portion of the developing nozzle, dried and oxidized, a carbonate compound is produced. The produced carbonate compound may possibly exfoliate off from the tip portion of the developing nozzle and attach to a wafer as a contaminant.

When the developing nozzle is not used for a long time or when the specs (recipe) of the process is changed, an operator manually cleans the tip portion of the developing nozzle. To render the developing nozzle ready to use after the cleaning, a trial output of the developing solution from the nozzle, called "dummy running", is required. However, these serially performed manual operations are quite complicated and becomes a burden of the operator.

BRIEF SUMMARY OF THE INVENTION

An object of the present invention is to provide an apparatus and method of cleaning a nozzle, and an apparatus of processing a substrate, capable of simplifying the cleaning operation and reducing a cleaning frequency of a tip of the processing solution nozzle by performing the cleaning in timing set in accordance with the most suitable mode defined by a type of processing liquid and state of use.

According to the present invention, there is provided an apparatus of cleaning a nozzle comprising:

- a mounting table for mounting a substrate to be processed;
- a process liquid nozzle having a liquid output portion for outputting a process liquid toward the substrate mounted on the table;
- a nozzle cleaning mechanism having a fluid spray portion for spraying a cleaning fluid onto the liquid output portion of the process liquid nozzle to remove an attached material from the liquid output portion by the cleaning fluid sprayed from the fluid spray portion; and
- a nozzle moving mechanism for moving the process liquid nozzle between the mounting table and the nozzle cleaning mechanism.

It is further desirable that the apparatus according to the present invention comprise

- means for setting a threshold which is a reference for determining whether cleaning of the liquid output portion of the process liquid nozzle is initiated or not; and
- control means for controlling the cleaning of the liquid output portion of the process liquid nozzle by counting at least one selected from the group consisting of a number of processed lots, a number of processed substrates, and non-operation time during which no process liquid is output from the process liquid nozzle, comparing a count value with the threshold, and initiating the cleaning of the liquid output portion of the process liquid nozzle by the nozzle cleaning mechanism when the count value exceeds the threshold.

According to the present invention, there is provided a method of cleaning a nozzle comprising the steps of:

(a) setting a threshold of at least one mode selected from the group consisting of a number of processed lots (lot mode), a number of processed substrates (substrate mode), and non-operation time (limit timer mode) during which no process solution is output from a process liquid nozzle, the threshold being a reference in determining whether cleaning of a liquid output portion of a process liquid nozzle is initiated or not;

(b) counting at least one selected from the group consisting of the number of processed lots, the number of processed substrates, and the non-operation time during which no process solution is output form the process liquid nozzle; and (c) initiating cleaning of the process liquid nozzle by spraying a cleaning fluid onto the process liquid nozzle when at least one selected from the group consisting of the number of processed lots (lot mode), the number of processed substrates (substrate mode), and the non-operation time (limit timer mode) during which no process solution is output from the process liquid nozzle, exceeds the threshold.

In the steps (a) to (c), either one or two modes are selected from the group consisting of the lot mode, the substrate mode, and the limit timer mode, and cleaning of the process liquid nozzle is initiated by using a mode thus selected.

In the step (c), It is preferable that the process liquid is output from the process liquid nozzle when the process liquid nozzle is cleaned.

According to the present invention, there is provided an apparatus of processing a substrate comprising:

- a mounting table for mounting a substrate having a pattern-exposed photoresist film;
- a developing nozzle having a liquid output portion for outputting a developing solution toward the photoresist film of the substrate on the mounting table;
- a nozzle cleaning mechanism having a cleaning fluid spray portion for selectively spraying pure water and an inert gas toward the liquid output portion of the developing nozzle and removing an attached material from the liquid output portion with the pure wafer and the insert gas sprayed from the cleaning fluid spray portion; and
- a nozzle moving mechanism for moving the developing nozzle between the mounting table and the nozzle cleaning mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, various preferred embodiments of the present invention will be explained with reference to the accompanying drawings.

Figure 1:
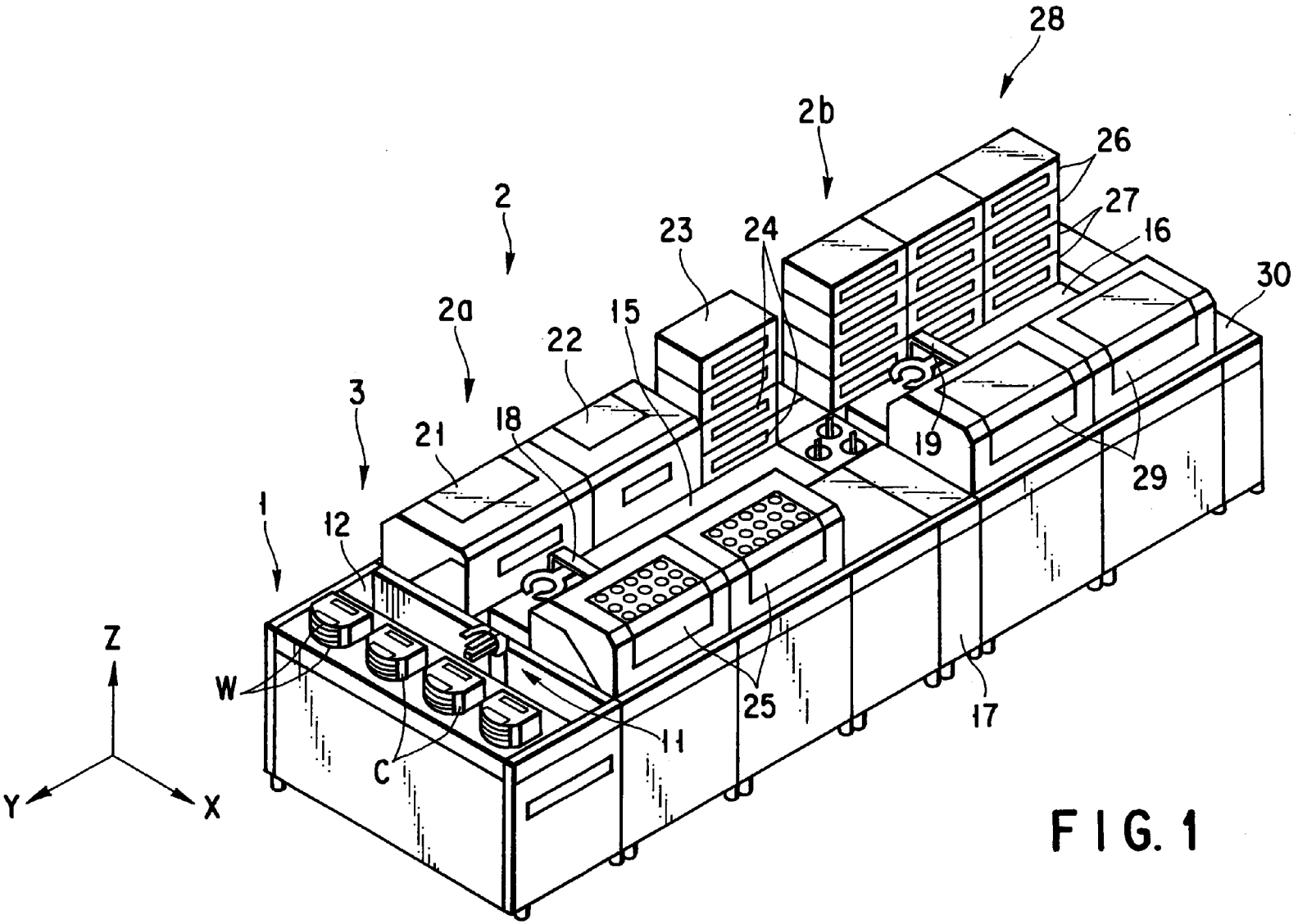
FIG. 1 is a schematic perspective view of a resist coating/developing system.

As shown in FIG. 1, the resist coating/developing system has a loader/unloader section 1, a process section 2, a plurality of transport arm mechanisms 11, 18, 19, a relay section 17, and an interface section 30. The loader/unloader section 1 has a cassette mounting table and a sub transport arm mechanism 11. The cassette mounting table extends in an X-axis direction. Four cassettes C are mounted on the cassette table. Unprocessed wafers W are stored in two cassettes C. Processed wafers W are stored in remaining two cassettes C.

A transport passage 12 extends along the cassette mounting table. The sub transport arm mechanism 11 is movably arranged within the transport passage 12. The sub transport arm mechanism 11 is responsible for taking out an unprocessed wafer W from a cassette C and placing a processed wafer W into a cassette C.

The process section 2 consists of two sections 2*a*, 2*b*. Each of the two sections 2*a* and 2*b* has a plurality of processing units 21–25, 26–29 and main transport arm mechanisms 18, 19. The first process section 2*a* is arranged next to the loader/unloader section 1. A transport passage 15 extending in a Y axis-direction, is provided in the center.

A first main transport arm mechanism 18 is movably provided along the transport passage 15. Along one side of the transport passage 15, a scrubbing unit 21, a water cleaning unit 22, an adhesion unit 23 and a cooling unit 24 are arranged. Along the other side of the transport passage 15, two resist coating units 25 are arranged.

The second process section 2*b* is connected to the first process section 2*a* with a relay section 17 interposed between them, and also connected to a light exposing apparatus (not shown) with the interface section 30 interposed between them. A transport passage 16 extending in the Y-axis direction is arranged in the center of the second process section 2*b*. A second main transport arm mechanism 19 is movably arranged along the transport passage 16. Along one side of the transport passage 16, a thermal unit group 28 consisting of a plurality of heat processing units 26 and cooling units 27, is arranged. Along the other side of the transport passage 16, two developing units 29 are arranged.

Two units arranged in the first and second stages from the top of the thermal unit 28 are heat processing units 26. Two units arranged in the first and second stages from the bottom are cooling units 27. The heat processing unit 26 is responsible for heat treatment such as prebaking for resist stabilization, post-exposure baking (PEB) performed after pattern exposure, and post-baking after development.

The first main transport arm mechanism 18 not only passes a wafer W to/from the sub transport arm mechanism 11 but also transports the wafer W to each of the processing units within the first process section 2*a*. The second main transport arm mechanism 19 not only passes the wafer W to/from the first main transport arm mechanism 18 via the relay section 17 but also transports the wafer W to each of processing units within the second process section 2*b*.

Figure 2:
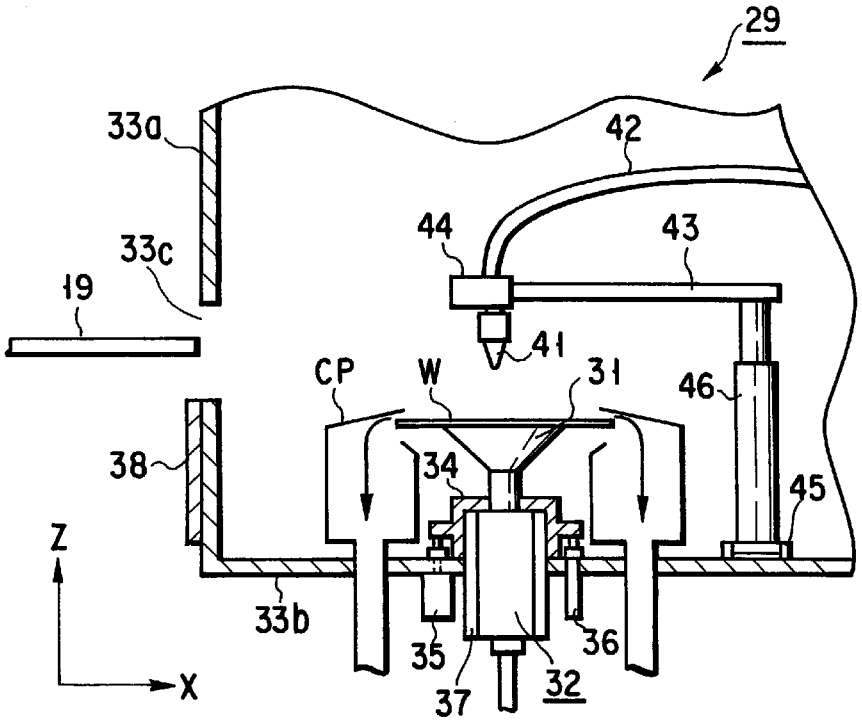
FIG. 2 is a perspective side view of the developing unit.

Next, the developing unit 29 will be explained with reference to FIGS. 2 and 3.

A cup CP is arranged at the center of the developing unit 29. A spin chuck 31 is arranged in the cup CP. The spin chuck 31 has a vacuum adsorption mechanism (not shown) and a rotation driving mechanism. A unit 29 has a loading/unloading port 33*c* openable by a shutter 38, in the front surface board 33*a*. The wafer W is loaded into/unloaded from the unit 29 through the loading/unloading port 33*c* by the main transport arm mechanisms 18, 19.

A motor 32 serving as the rotation driving mechanism, passes through the unit bottom plate 33*b* and connected to an aluminum flange cap 34. The flange cap 34 is supported by the rod of a cylinder mechanism 35 and an upward and downward moving guide 36. When a rod is allowed to protrude from the cylinder 35, the motor 32 and the spin chuck 31 are moved up like a unitary member. Note that a cooling jacket 37 made of stainless steel is attached to a side surface of the motor 32. The upper half portion of the cooling jacket 37 is covered with the flange cap 34.

During the developing process, the lower end of the flange cap 34 comes into tight contact with a unit bottom plate 33*b* near the periphery of the opening of the unit bottom plate 33*b*, so that the inner portion of the unit 29 is maintained airtight. When the wafer W is transferred between the spin chuck 31 and the main transport arm mechanism 19, the spin chuck 31 is moved up by the cylinder mechanism 35.

The developing nozzle 41 is communicated with the developing solution supply unit 82 (shown in FIG. 7) by way of a supply pipe 42. The developing solution supply unit 82 houses a tank storing an aqueous TMAH solution serving as a developing solution. The developing nozzle 41 is detachably attached to a tip portion of the arm 43 via a holder 44. The arm 43 is supported by a post 46. The post 46 is moved by a Y-axis driving mechanism (not shown) along a guide rail 45 extending in the Y-axis direction. The arm 43, which extends in the X-axis direction, is extended or contracted by an X-axis driving mechanism (not shown).

Figure 3:
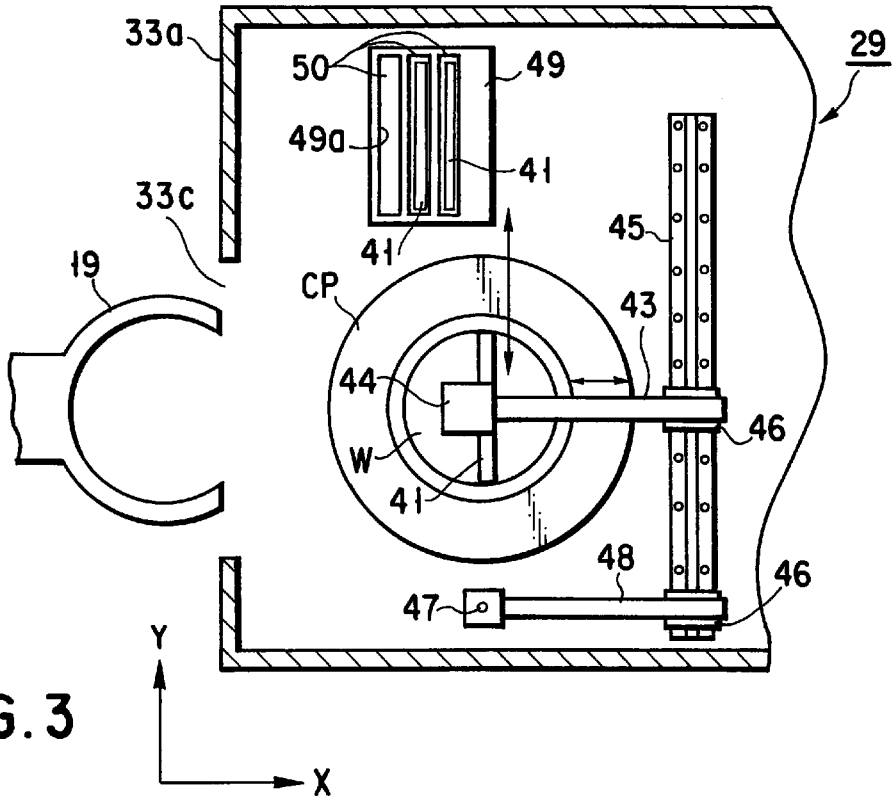
FIG. 3 is a perspective plan view of the developing unit.

As shown in FIG. 3, the developing nozzle 41 is a linear-type nozzle extending in the Y-axis direction. Numeral fine holes are formed in the liquid output portion 41*a* of the nozzle 41. The length of the liquid output portion 41*a* is nearly equal to the diameter of the wafer W. Note that an assembly of nozzles consisting of a plurality of nozzles arranged side by side may be used as the developing nozzle 41. Alternatively, a nozzle having the slit-form liquid output holes, may be used.

A rinse nozzle 47 communicates with a pure wafer supply unit 83 (shown in FIG. 7) by way of a supply pipe (not shown). The rinse nozzle 47 is attached to a tip portion of an arm 48, which is supported by the post 46. The post 46 is movably arranged in the Y-axis direction along the guide rail 45.

The nozzle stand-by section 49 is arranged in the development unit 29. The nozzle stand-by section 49 is arranged at a distance from the cup CP. When a plurality of developing nozzles 41 are not in use, they are placed in the stand-by section 49. There are a plurality of insert ports in the nozzle stand-by section 49. The liquid output portion 41*a* of each of the developing nozzles 41 is inserted into the corresponding insert port 49*a*. The insert port 49*a* communicates with a chamber containing an atmosphere of the developing solution. The arm 43 moves to the nozzle stand-by portion 49 and picks up one from the plurality of nozzles 41 by the holder 44, as shown in FIG. 3. Operations of the moving mechanisms for the developing nozzle 41 and the rinse nozzle 47 are controlled by a controller 60 as described later.

Now, a development operation performed in the developing unit 29 will be explained.

First, the shutter 38 is opened, and then, a wafer W is inserted into the developing unit 29 by the main transport arm mechanism 19. Subsequently, the spin chuck 31 is moved up to mount the wafer W on the spin chuck 31 and then, the wafer W is vacuum adsorbed. The arm holder of the main transfer arm mechanism 19 is withdrawn from the unit 29. The shutter 38 is closed and the spin chuck 31 is moved down.

Next, while the developing nozzle 41 is moved from the stand-by section 49 to above the nozzle 41, the wafer W is rotated in a half circle or in a complete circle. In this manner, the developing solution is spread over an entire surface of the wafer W, with the result that a liquid film of the developing solution is formed on the wafer W in a thickness of, for example, about 1 mm. Subsequently, the wafer W is rotated at a low speed, with the result that the developing solution placed on the wafer W is stirred by convection. While this state is maintained for a predetermined time to bring the developing solution into sufficient contact with a photoresist, a latent pattern image is developed.

When the developing process is completed, the developing nozzle 41 is withdrawn to the stand-by section 49. The developing solution is shaken off by rotating the wafer W by the spin chuck 31. Subsequently, the rinse nozzle 47 is placed above the wafer W and a rinse solution (pure water) is poured onto the wafer W to wash away the developing solution. Furthermore, the spin chuck 31 is rotated at a high speed to remove attached solution from the wafer W, with the result that the wafer W is dried.

Now, the nozzle cleaning mechanism for cleaning the developing nozzle 41 will be explained with reference to FIGS. 4–7.

Figure 4:
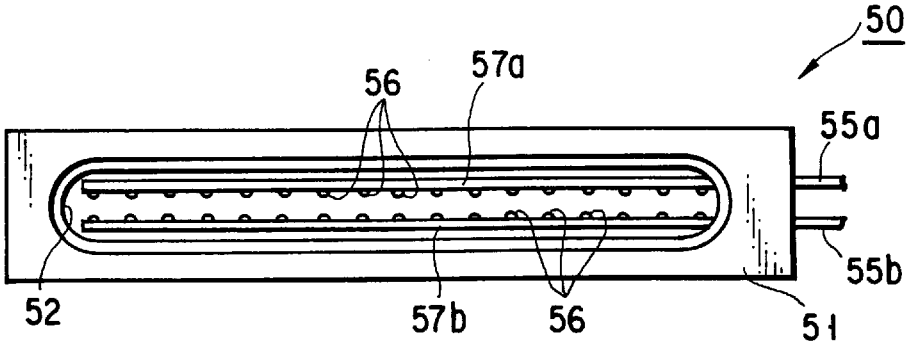
FIG. 4 is a plan view of a nozzle cleaning mechanism.
Figure 5:
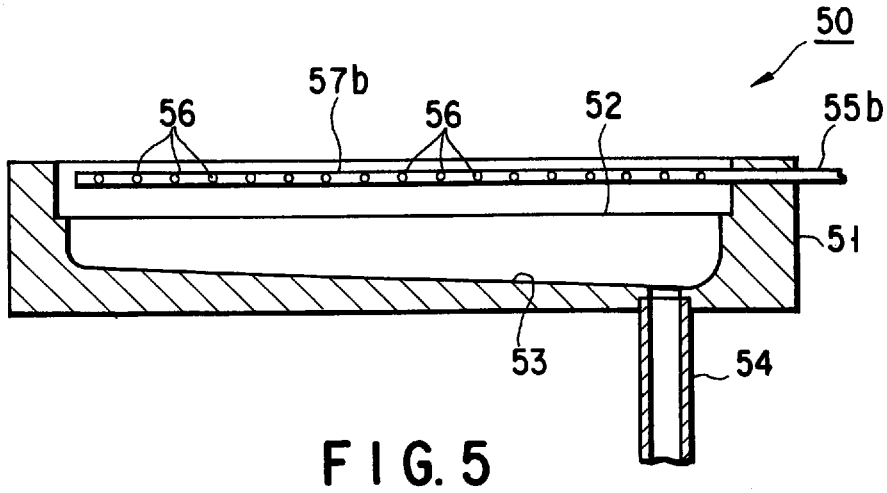
FIG. 5 is a longitudinal sectional view of the nozzle cleaning mechanism.
Figure 6:
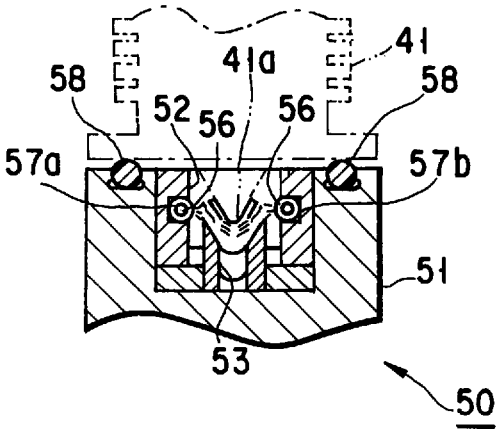
FIG. 6 is a cross sectional view of the nozzle cleaning mechanism at the time the developing nozzle is cleaned.

The nozzle cleaning mechanism (nozzle bath) 50 is arranged within the nozzle stand-by section 49 of the development unit 29. As shown in FIGS. 4, 5, 6, the nozzle cleaning mechanism 50 has a bath chamber 52 in which the liquid output portion 41*a* of the developing nozzle 41 can be housed. The bath chamber 52 is surrounded by a rectangular box case 51. Shower nozzles 57*a*, 57*b* are attached along the longitudinal side walls, respectively.

Figure 7:
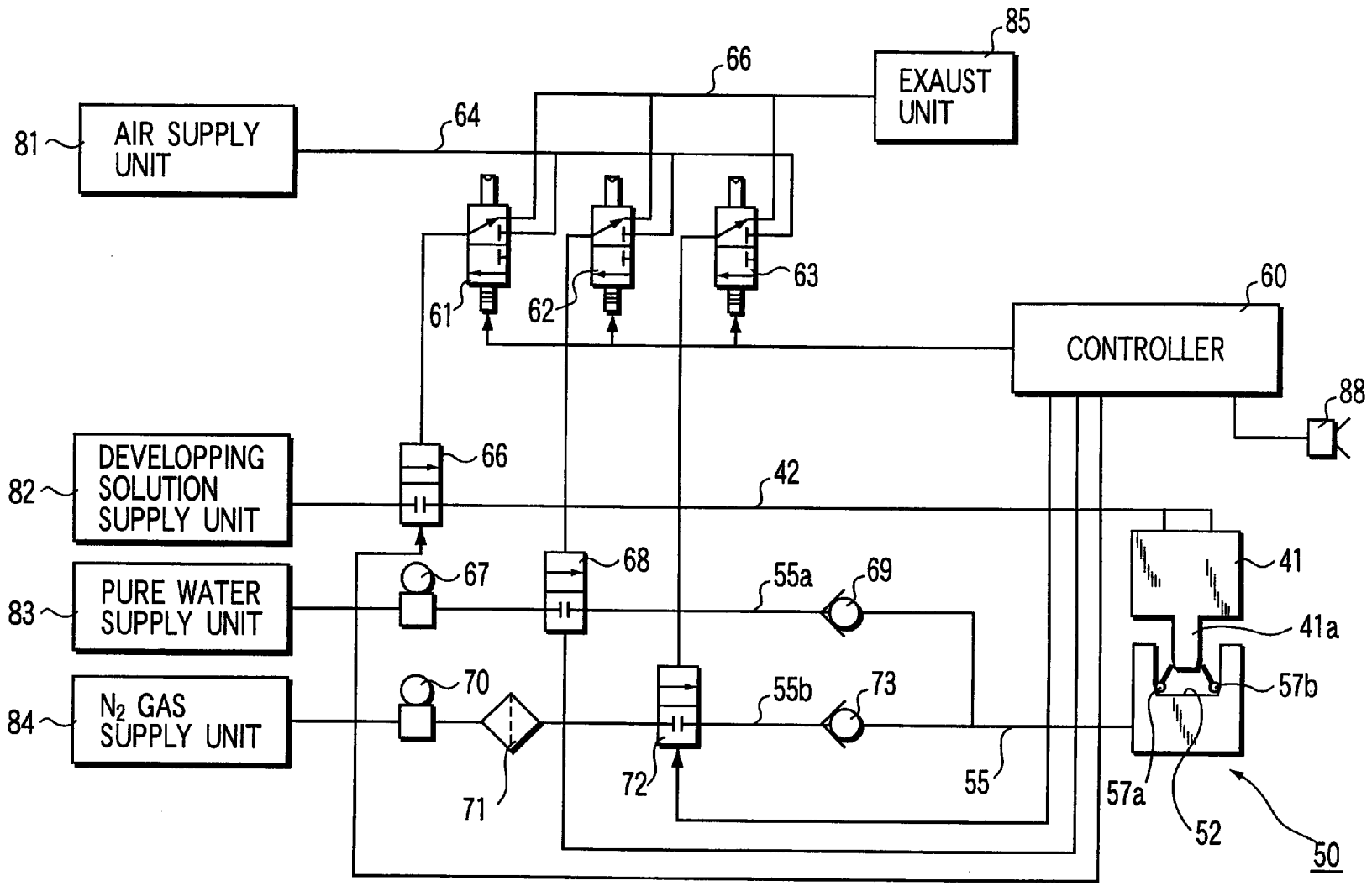
FIG. 7 is a block diagram showing a liquid supply circuit for supplying a liquid to the developing nozzle and the nozzle cleaning mechanism.

As shown in FIG. 7, each of the shower nozzles 57*a*, 57*b* communicates with the pure water supply unit 83 and a $N_2$ gas supply unit 84 through supply pipes 55*a*, 55*b*. Spray holes 56 of a pair of shower nozzles 57*a*, 57*b* are formed so as to face each other. As shown in FIG. 6, the liquid output portion 41*a* of the developing nozzle 41 is inserted between both shower nozzles 57*a*, 57*b*, a cleaning solution (pure water) is sprayed onto the liquid output portion 41*a* from both nozzles 57*a*, 57*b*, and thereafter $N_2$ gas is sprayed on.

Note that the bath chamber 42 may be force-evacuated by connecting the drain pipe 54 with an exhaust unit 85. Furthermore, the nozzle cleaning mechanism 50 may be arranged at a position other than the nozzle stand-by section 49.

As shown in FIGS. 5 and 6, a drain groove 53 is formed in the bottom surface of the bath chamber 52. The bottom surface of the drain groove 53 is moderately inclined downwardly toward the drain pipe 54. The drain pipe 54 is connected to the most lowest portion of the drain groove 53. Seal rings 58 are attached liquid-tight to the upper surface portion of the box case 51 so as not to leak liquid from the gap between the nozzle 41 and the cleaning mechanism 50.

Now, referring to FIG. 7, the circuit for supplying a developing solution, a cleaning solution (pure water) and an inert gas individually to the developing nozzle 41 and the nozzle cleaning mechanism 50, will be explained.

In the circuit, there are a developing solution supply line 42, a cleaning solution supply line 55*a*, a dry gas supply line 55*b* equipped with air operation valves (AOV) 66, 68, 72, respectively. An air driving chamber for the first AOV 66 communicates with an air supply chamber for a first electromagnetic control valve 61. When the first AOV 66 is driven by the first electromagnetic control valve 61, a developing solution is supplied to the nozzle 41 from the developing solution supply unit 82. The air driving chamber for the second AOV 68 communicates with an air supply chamber for a second electromagnetic control valve 62. The second AOV 68 is driven by the second electromagnetic control valve 62, pure wafer (cleaning solution) is supplied from a pure water supply unit 83 to the nozzles 57*a*, 57*b*. The air driving chamber for the third AOV 72 communicates with an air supply chamber for the third electromagnetic control valve 63. When the third AOV 72 is driven by a third electromagnetic control valve 63, an inert gas ($N_2$ gas) is supplied to the nozzles 57*a*, 57*b* from the $N_2$ gas supply unit 84.

These three electromagnetic control valves 61, 62, 63 individually communicate with not only an air supply unit 81 through an air supply pipe 64 but also an exhaust pipe 65. The exhaust pipe 65 may be directly communicated with air or an exhaust unit 85. Operations of these electromagnetic control valves 61, 62, 63 and AOV 66, 68, 72 are individually controlled by the controller 60.

A line 55 communicating with the cleaning nozzles 57*a*, 57*b* is branched into a cleaning solution supply line 55*a* and a dry gas supply line 55*b*. To the cleaning solution supply line 55*a*, a regulator 67, the second AOV 68, and a nonreturn valve 69 are attached in the order mentioned. To the dry gas supply line 55*b*, a regulator 70, a filter 71, a third AOV 72, and a nonreturn valve 73 are attached in the order mentioned.

The alarm unit 88 is connected to an output portion of the controller 60 in order to warn that the nozzle is under cleaning.

In the supply circuit thus constructed, compressed air is supplied from the air supply unit 81 to the air supply pile 64 all the time. When the developing solution is output from the developing nozzle 41, the controller 60 controls first electromagnetic control valve 61 so as to supply the developing solution by the first AOV 66. It follows that the developing solution is output from the developing nozzle 41.

When the cleaning solution (pure water) is output from the cleaning nozzles 57*a*, 57*b*, the controller 60 operates the second electromagnetic valve 62 so as to supply the cleaning solution (pure water) by the second AOV 68. It follows that the cleaning solution is sprayed out from the cleaning nozzles 57*a*, 57*b*.

Furthermore, when an inert gas ($N_2$ gas) is sprayed out from the cleaning nozzles 57*a*, 57*b*, the controller 60 operates the third electromagnetic control valve 63. In this way, an inner flow passage of the third AOV 72 is switched from the line 55*a* to the line 55*b*, thereby spraying out the inert gas ($N_2$ gas) from the cleaning nozzles 57*a*, 57*b*.

Note that a temperature/humidity control unit may be attached to the line 55*b* to control temperature and humidity of the inert gas ($N_2$ gas).

Now, how to clean the liquid output portion of the developing nozzle will be outlined.

When the liquid output portion 41*a* of the developing nozzle 41 is inserted into the bath chamber 52, a cleaning solution (pure water) is sprayed onto the liquid output portion 41*a* from the shower nozzles 57*a*, 57*b*. In this way, the attached developing solution is removed from the liquid output portion 41*a* of the developing nozzle 41 and thus the liquid output portion 41*a* is cleaned. The drainage solution flows along the drain groove 53 and discharged by way of the drain pipe 54. Note that the cleaning solution is sprayed from the nozzles 57*a*, 57*b*, at the same time, the developing solution may be output from the developing nozzle 41. Subsequently, $N_2$ gas is sprayed onto the liquid output portion 41*a* from the shower nozzles 57*a*, 57*b* to blow away liquid drops from the liquid output portion 41*a*. Incidentally, the attached material can be removed from the developing nozzle 41 by either spraying the cleaning solution or blowing a gas. In this case, a spray pressure of a fluid (pure water or $N_2$ gas) must be increased.

Now, referring to FIGS. 8A, 8B, 8C, various cleaning initiation modes will be explained when the developing nozzle is cleaned by the nozzle cleaning mechanism 50.

Figures 8A, 8B, 8C:
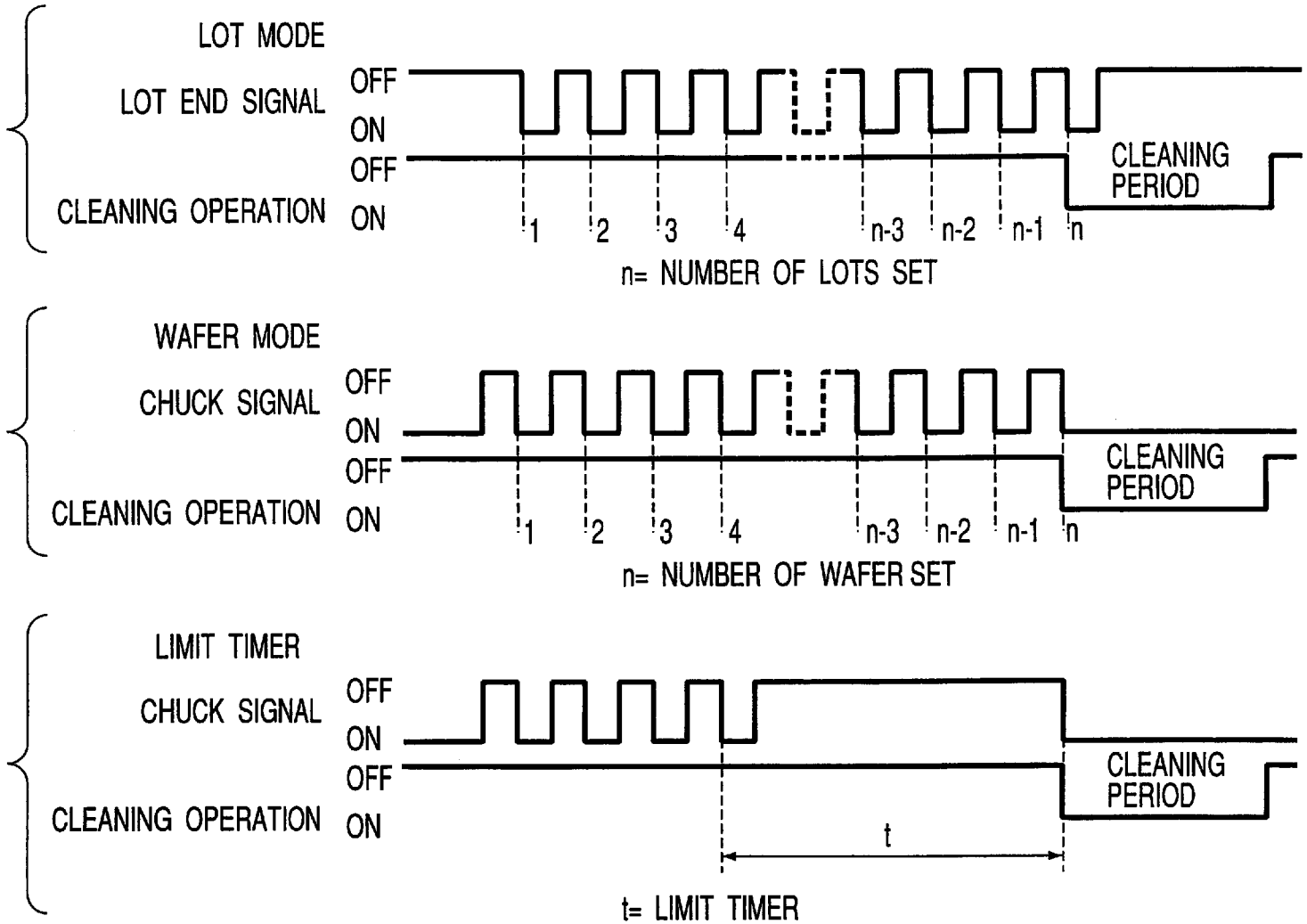
FIG. 8A is a timing chart of a lot mode.
FIG. 8B is a timing chart of a wafer mode.
FIG. 8C is a timing chart of a limit timer mode.

FIG. 8A shows a timing chart of a lot mode. FIG. 8B is a timing chart of a wafer mode. FIG. 8C is a timing chart of a limit timer mode.

In the lot mode, 25 wafers W are handled as one lot. The nozzle cleaning operation is set so as to initiate every time n number of lots are cleaned, as shown in FIG. 8A. The counting of the lot number is started by the controller 60 immediately after completion of a preceding cleaning operation. When the count number of lots reaches n, the cleaning operation of the nozzle 41 is initiated.

In the wafer mode, the nozzle cleaning operation is set to initiate every time n number of wafers are cleaned, as shown in FIG. 8B. The number of wafers is counted by the controller immediately after completion of a preceding cleaning operation. When the number of wafers reaches n, the cleaning operation of the nozzle 41 is initiated.

In the limit timer mode, non-operation time during which no developing solution is output from the developing nozzle 41, is counted, as shown in FIG. 8C. When the non-operation time reaches the limit time t, the nozzle cleaning operation is initiated. To describe more specifically, the controller 60 first counts the time from immediately after the developing solution is supplied to a preceding wafer until initiation of the supply of the developing solution to the following wafer. Second, the controller 60 compares the non-operation time thus counted with the limit time t. When the non-operation time exceeds the time limit t, the controller initiates the cleaning operation of the nozzle 41. The "time limit t" used herein is a time limitation at which the developing solution placed under a reference humidity and temperature is converted into a carbonate compound. The "time limit t" is determined experimentally.

The lot mode may be used in combination with the limit timer mode. More specifically, the cleaning operation of the nozzle 41 may be initiated when either the lot number reaches n or the non-operation time of the nozzle 41 exceeds the limit time t (called "lot limit timer mode"). Alternatively, the wafer mode may be used in combination with the limit timer mode. To explain more specifically, the cleaning operation of the nozzle 41 may be initiated when the count number of wafers W reaches n, or the non-operation time of the nozzle 41 exceeds the time limit t (called "wafer limit timer mode").

Figure 9:
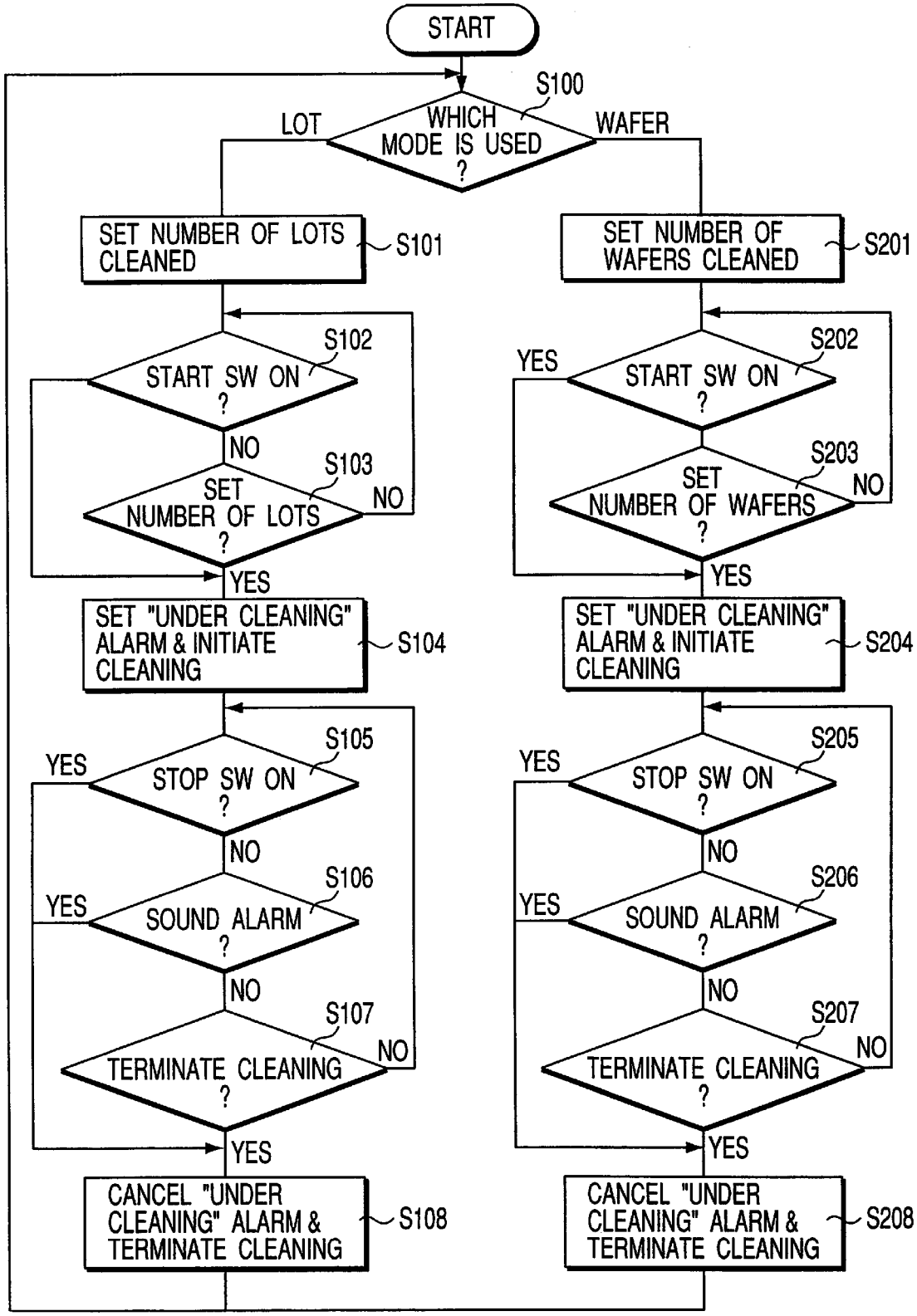
FIG. 9 is a flowchart showing a method of cleaning a nozzle according to an embodiment of the present invention.
Figures 10A, 10B, 10C, 10D:
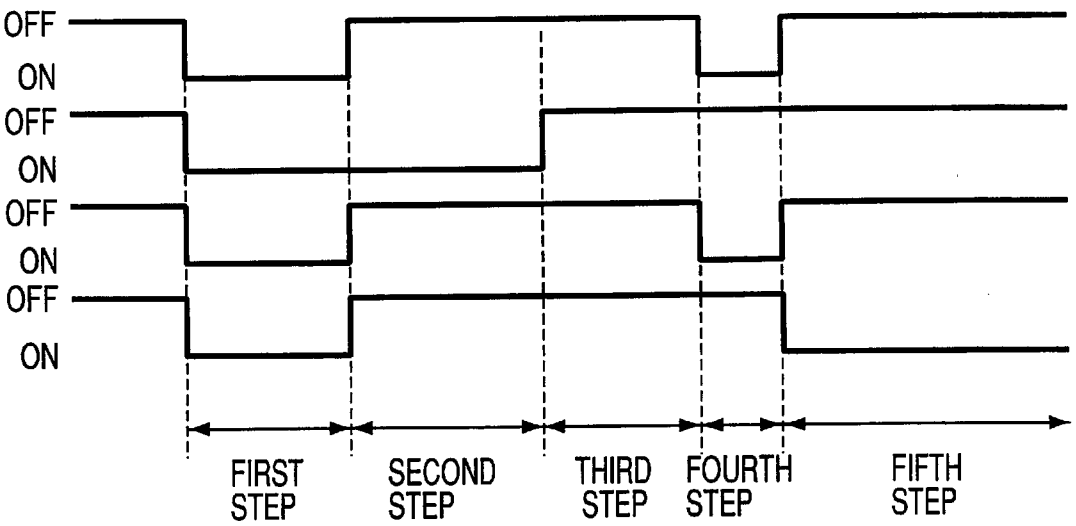
FIG. 10A is a timing chart showing output timing of the developing solution from the developing nozzle.
FIG. 10B is a timing chart showing output timing of pure water of the nozzle cleaning mechanism.
FIG. 10C is a timing chart showing blown-out timing of $N_2$ gas.
FIG. 10D is a timing chart showing a timing of an alarm during a cleaning step.

Now, referring to the flow chart of FIG. 9, an example of the cleaning operation performed in accordance with the lot mode or the wafer mode will be explained.

First, an operator (and/or the controller 60) selects a mode to be employed in initiating the nozzle cleaning from the lot mode and the wafer mode (Step S100). In the case where the lot mode is selected in the step S100, the operator (and/or the controller 60) inputs a preset number (n) of lots as the lot number to be developed from completion of the preceding cleaning operation to initiation of the following cleaning operation (Step S101). Furthermore, the operator determines whether a switch for initiating the cleaning operation should be turned on or not in accordance with a manual (Step S102). If the determination of the step S102 is YES, the cleaning operation of the nozzle is initiated (Step S104).

Then, the controller 60 counts the number of developed lots. When the count number of developed lots reaches n (Step S103), the cleaning operation is initiated by the nozzle cleaning mechanism 50 (Step S104). At the same time, the controller 60 actuates the alarm unit 88 warning that the nozzle is under cleaning.

The operator (and/or the controller 60) determines whether the switch for terminating the cleaning operation is turned on or not (Step S105). If the determination of the step S105 is YES, the cleaning operation of the nozzle is terminated (Step S108). Furthermore, the operator (and/or controller 60) determines whether a situation requiring the warning takes place or not (Step S106). If the determination of the step S106 is YES, the cleaning operation of the nozzle is terminated (Step S108). Furthermore, the operator (and/or controller 60) determines whether the cleaning operation is completed or not (Step S107). If the determination of the step S107 is YES, the cleaning operation of the nozzle is terminated (Step S108). In the step S108, when the cleaning operation of the nozzle is terminated upon receipt of instructions from the steps S105–107, not only the cleaning operation of the nozzle but also the operation of the alarm unit 88 are terminated.

On the other hand, when the wafer mode is selected in the step S100, the operator (and/or the controller 60) sets the number of wafers W to be processed from completion of a preceding cleaning operation to initiation of the following cleaning operation, to n sheets (Step S201). The operator determines whether the switch for initiating the cleaning operation should be turned on or not in accordance with a manual (Step S202). If the determination of the step S202 is YES, the cleaning operation of the nozzle is initiated (Step S204). Furthermore, the number of developed wafers is counted by the controller 60. When the count number reaches n sheets (Step S203), the cleaning operation is initiated by the nozzle cleaning mechanism 50 (Step S204). At the same time, the controller 60 actuates the alarm unit 88 warning that the nozzle is under cleaning.

The operator (and/or the controller 60) determines whether a switch for terminating the cleaning operation is turned on or not in accordance with a manual (step S205). If the determination of the step S205 is YES, the cleaning operation of the nozzle is terminated (Step S208). Furthermore, the operator (and/or the controller 60) determines whether a warning-required situation takes place or not (Step S206). If the determination of the step S206 is YES, the cleaning operation of the nozzle is terminated (Step S208). Furthermore, the operator (and/or the controller 60) determines whether the cleaning operation of the nozzle is completed or not (Step S207). If the determination of the Step S207 is YES, the cleaning operation of the nozzle is terminated (Step S208). Note that, in the step S208, upon receipt of instructions from the steps S205–207, not only the cleaning operation of the nozzle but also the operation of the alarm is terminated.

Now, an exemplary pattern of the nozzle cleaning operation will be explained with reference to FIGS. 10A to 10D.

The nozzle cleaning is performed upon instruction from the controller 60 and/or the operator. In this case, the first step to the fifth step is handled as one cycle. In the first step, when the cleaning of the developing nozzle 41 is initiated, the developing solution is output from the developing nozzle 41 itself, at the same time, the cleaning solution (pure water) is sprayed onto the liquid output portion 41*a* of the developing nozzle from the cleaning nozzle (shower nozzle) 57*a*, 57*b*. In the second step, the output of the developing solution from the developing nozzle 41 is terminated, whereas the cleaning solution (pure water) is continued to be sprayed from the cleaning nozzles 57*a*, 57*b*. In the third step, the spray of the cleaning solution (pure water) from the cleaning nozzles 57*a*, 57*b* is terminated and the developing nozzle 41 is allowed to stand-by as it is for a predetermined time. In the fourth step, the developing solution is output from the developing nozzle 41 (dummy dispense). In the fifth step, the output of the developing solution from the developing nozzle is terminated and an inert gas ($N_2$ gas) is sprayed onto the liquid output portion 41*a* of the developing nozzle form the cleaning nozzles (shower nozzle) 57*a*, 57*b*.

If the developing nozzle is cleaned in accordance with a cleaning pattern from the first step to the fifth step, it is possible to prevent generation of a carbonated compound which is a source for particles. As a result, contamination of the wafer w can be efficiently prevented.

In the aforementioned embodiments, the photoresist film formed on a semiconductor wafer is used as an object to be processed. However, the present invention is not limited to this. A photoresist film formed on another substrate such as a glass substrate for LCD may be used as the object.

In the aforementioned embodiments, the case of cleaning the developing nozzle is explained. However, the present invention is not limited to this. The present invention may be applied to the case where other nozzles such as a resist coating nozzle, a rinse nozzle, and Spin-On Dielectric (SOD) nozzle are cleaned.

According to the present invention, a cleaning process manually performed by an operator is not required. A trial output of a liquid called "dummy running" which is performed to render the nozzle ready to use after the cleaning process, is no longer required. Therefore, the cleaning operation of the nozzle can be simplified and the frequency of the nozzle cleaning can be reduced. Furthermore, if the most suitable mode is selected from various types of modes in accordance with a type of processing liquid and a situation, the nozzle cleaning can be more simplified and the frequency of the nozzle cleaning can be reduced more.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of cleaning a nozzle comprising the steps of:

(a) setting a threshold of at least one mode selected from the group consisting of a number of processed lots (lot mode), a number of processed substrates (substrate mode), and non-operation time (limit timer mode) during which no process solution is output from a process liquid nozzle, said threshold being a reference in determining whether cleaning of a liquid output portion of a process liquid nozzle is initiated or not;

(b) counting at least one selected from the group consisting of the number of processed lots, the number of processed substrates, and the non-operation time during which no process solution is output form the process liquid nozzle; and (c) initiating cleaning of the process liquid nozzle by spraying a cleaning fluid onto the process liquid nozzle when at least one selected from the group consisting of the number of processed lots (lot mode), the number of processed substrates (substrate mode), and the non-operation time (limit timer mode) during which no process solution is output from the process liquid nozzle, exceeds the threshold.

2. A method according to claim 1, wherein, in the steps (a) to (c), either one or two modes are selected from the group consisting of the lot mode, the substrate mode, and the limit timer mode, and cleaning of the process liquid nozzle is initiated by using a mode thus selected.

3. A method according to claim 1, wherein, in the step (c), the process liquid is output from the process liquid nozzle when the process liquid nozzle is cleaned.

* * * * *